US012790056B2

(12) United States Patent
Cheri-Zecote et al.

(10) Patent No.: US 12,790,056 B2
(45) Date of Patent: Nov. 10, 2026

(54) DEVICE AND METHOD FOR FORMING A SEPARATION LINE IN A PACK OF POTS OF FOOD PRODUCT

(71) Applicant: SYNERLINK, Puiseux Pontoise (FR)

(72) Inventors: Eddy Cheri-Zecote, Genicourt (FR); Dominique Cossais, Sainte Geneviève des Bois (FR); Hervé Delaunay, Puiseux-Pontoise (FR); Stéphane Tauger, Cerans Foulletourte (FR)

(73) Assignee: SYNERLINK, Puiseux Pontoise (FR)

( * ) Notice: Subject to any disclaimer, the term of this patent is extended or adjusted under 35 U.S.C. 154(b) by 0 days.

(21) Appl. No.: 18/692,488

(22) PCT Filed: Sep. 13, 2022

(86) PCT No.: PCT/FR2022/051718
§ 371 (c)(1),
(2) Date: Mar. 15, 2024

(87) PCT Pub. No.: WO2023/041865
PCT Pub. Date: Mar. 23, 2023

(65) Prior Publication Data

US 2024/0425218 A1 Dec. 26, 2024

(30) Foreign Application Priority Data

Sep. 15, 2021 (FR) ..... 2109673

(51) Int. Cl.
*B65B 61/04* (2006.01)
*B65B 51/04* (2006.01)
(Continued)

(52) U.S. Cl.
CPC ..... *B65B 61/18* (2013.01); *B65B 51/04* (2013.01); *B65B 51/32* (2013.01); *B65B 61/005* (2013.01);
(Continued)

(58) Field of Classification Search
CPC ..... B65B 61/18; B65B 51/04; B65B 61/005; B65B 2220/22; B65B 2230/02; B65B 61/04; B65D 75/527
(Continued)

(56) References Cited

U.S. PATENT DOCUMENTS 3,703,841 A * 11/1972 Crawford ..... B26D 1/626 83/345
3,874,143 A * 4/1975 Braber ..... B65D 75/327 53/133.8
(Continued)

FOREIGN PATENT DOCUMENTS

DE 8611023 U1 12/1987
EP 0654328 A1 5/1995
(Continued)

OTHER PUBLICATIONS

International Search Report issued on Jan. 3, 2023, in corresponding International Patent Application No. PCT/FR2022/051718; 5 pages.
(Continued)

*Primary Examiner* — Gloria R Weeks
(74) *Attorney, Agent, or Firm* — Maier & Maier, PLLC

(57) ABSTRACT

A cutting tool for a device for forming a precut in a pack of pots of food product, the precut facilitating a separation by breaking apart two pots of food product along a separating line between them, the cutting tool including a cutting portion that extends along a longitudinal axis and is configured to form a precut groove along the separating line. Viewed from the front, the cutting portion includes a convex profile.

13 Claims, 4 Drawing Sheets

(51) Int. Cl.

| | |
|---|---|
| ***B65B 51/32*** | (2006.01) |
| ***B65B 61/00*** | (2006.01) |
| ***B65B 61/18*** | (2006.01) |
| ***B65D 75/32*** | (2006.01) |
| ***B65D 75/52*** | (2006.01) |

(52) U.S. Cl.
CPC ..... *B65D 75/327* (2013.01); *B65D 75/527* (2013.01); *B65B 2220/22* (2013.01); *B65B 2230/02* (2013.01)

(58) Field of Classification Search
USPC ..... 53/133.1; 83/13
See application file for complete search history.

(56) References Cited

U.S. PATENT DOCUMENTS

| | | | | |
|---|---|---|---|---|
| 4,012,888 | A * | 3/1977 | Nichols | B65B 59/04 53/131.5 |
| 5,423,240 | A * | 6/1995 | DeTorre | B26D 3/003 30/375 |
| 5,456,010 | A * | 10/1995 | Bryda | B26B 3/04 30/286 |
| 6,662,531 | B1 * | 12/2003 | Schwab | B65B 61/065 53/453 |
| 2017/0274680 | A1 | 9/2017 | Kosuge | |
| 2020/0139568 | A1 | 5/2020 | Higgins | |

FOREIGN PATENT DOCUMENTS

| | | | |
|---|---|---|---|
| EP | 3766799 | A1 | 1/2021 |
| EP | 3885085 | A2 | 9/2021 |
| EP | 3885085 | A3 | 12/2021 |
| WO | 2011130024 | A1 | 10/2011 |

OTHER PUBLICATIONS

French Search Report issued on Jun. 2, 2022, in corresponding French Patent Application No. 2109673; 8 pages.

* cited by examiner

DEVICE AND METHOD FOR FORMING A SEPARATION LINE IN A PACK OF POTS OF FOOD PRODUCT

FIELD

This disclosure relates to tools and devices for forming a precut in a pack of pots of food product.

BACKGROUND

Food products in batches or packs, such as dairy products whether liquid, creamy, pasty, or foamy, are typically contained in a multi-compartment container obtained by forming plastic. After forming, the compartments are filled with the food product and sealed with a lid. Grooving or precutting is subsequently carried out to score the lid and the plastic material to a certain depth, allowing the pack to be separated by splitting it into a plurality of pots.

In order to increase the recyclability of the pots after use, there is a trend towards using polyethylene terephthalate (PET) to form the packs. Recycling of this plastic is in fact common and well controlled.

However, in the case where the container is formed of PET, there is a need to adapt the grooving in order to obtain a satisfactory separation when breaking the pots apart.

Document EP3766799 describes a device for forming a precut in a pack of pots of food products, comprising a first cutting tool configured to make a precut groove in the pack from above, and a second cutting tool configured to make a precut groove in the pack from below.

In effect, this device makes it possible to facilitate the separation of pots of food product by folding and breaking them apart, for a range of plastics including PET in particular. However, the grooves made are not very effective, particularly in certain types of plastics or in certain lengths of precuts. When separating two pots, the break does not follow the precut grooves satisfactorily. In addition, the precut grooves tend to reduce the rigidity of the pack. The pots thus also have poor inter-pot stability.

There is therefore a need for a cutting tool and a device for forming a precut which do not have at least some of the disadvantages of the prior art.

SUMMARY

A cutting tool is proposed for a device for forming a precut in a pack of pots of food product, said precut facilitating the separation of two pots of food product by breaking them apart along a separating line between them, the cutting tool comprising a cutting portion extending along a longitudinal axis and configured to make a precut groove along the separating line, wherein, viewed from the front, the cutting portion comprises a convex profile.

Also proposed is the device for forming the precuts in the pack of pots of food product, comprising at least one cutting tool as above.

Such a cutting tool makes it possible to vary the breaking force required to separate two pots of food products along the separating line. At the top of the convex profile, the thickness of the plastic between two pots is minimal. This area is thus weakened, facilitating the break and reducing the risk of the break deviating from the separating line. The thickness of the plastic increases as one moves away from the top, ensuring even breakage along the separating line.

The features set forth in the following paragraphs may optionally be implemented, independently of one another or in combination with one another.

The convex profile may be symmetrical relative to a transverse axis of the cutting tool. Thus, the minimal thickness of the plastic is at a central area of the separating line. The closer one is to the ends of the separating line, the greater the thickness of the plastic. The gradual increase in thickness towards the ends of the separating lines ensures good stability between the pots.

Viewed from the front, the convex profile may extend between a first point on one end of the cutting tool and a second point on the transverse axis, the straight line connecting the first and second points forming an angle of between 0.1° and 2.2° with the longitudinal axis. Such angles ensure a good compromise between the breaking force required to separate the pots and a good stability between the pots when they are in packs.

Viewed in cross-section, the cutting portion may comprise a flat face and a face that is inclined relative to the flat face so as to form a beveled cutting portion. The cutting portion terminates in a sharp end which ensures a clean and precise cut of the plastic. It is also possible to place a first cutting tool to perform a precut from above and a second cutting tool to perform a precut from below, in a device for forming the precuts. By placing the flat faces of the first and second cutting tools oriented towards each other, it is possible to make a complete cut between the two pots without interference between the first cutting tool and the second cutting tool.

The angle formed by the flat face and the inclined face may be between 10° and 60°. Such angles can ensure satisfactory precutting or complete cutting in plastic thicknesses varying from 0.6 to 2 mm, without dulling the cutting portion during repeated use.

The cutting tool may further comprise a cylindrical portion extending in the direction normal to the longitudinal axis. The cutting tool may be mounted in a support plate of the device for forming a precut. Different geometries of cutting portions may be mounted in the same support plate.

The cylindrical portion may comprise a threaded hole extending along the axis of revolution of the cylindrical portion, the threaded hole being configured to receive a retaining screw for the device for forming a precut, the retaining screw being capable of fixing the cutting tool in a support plate. The cutting tool may be received in the support plate of the device for forming a precut in a manner that is adjustable. It is possible to adjust the distance that the cutting portion projects from the support plate, in order to make precuts over a range of plastic thicknesses.

The cutting tool may be configured to be urged by a spring when the cutting tool is making a precut, with the spring pressing against the retaining screw and the support plate. The spring helps with precisely adjusting the position of the precut tool in the support plate, in order to adjust the depth of the precut groove.

The cylindrical portion may comprise a cylindrical recess configured to receive an O-ring of the device for forming a precut. The O-ring prevents the introduction of dust or contaminants into the space where the packs of food product are located.

According to another aspect, a device is proposed for forming a precut in a pack of pots of food product, said precut facilitating the separation of two pots of food product by breaking them apart along a separating line between them, the device comprising:

a first cutting tool configured to make a precut groove along the separating line from above, and a second cutting tool configured to make a precut groove along the separating line from below, wherein, viewed from the front, the first cutting tool and/or the second cutting tool comprises a cutting portion having a convex profile.

A precut is made both from above, in order to cut a cover sheet and create a weakness in an upper face of the plastic material, and from below, in order to create an area of weakness in the lower face of the plastic material, facilitating separation by bending and breaking packs apart, particularly for packs formed of polyethylene.

The convex profile may be provided on the first cutting tool, the second cutting tool, or the first and second cutting tools. The convex profile makes it possible to vary the breaking force required to separate two pots of food product along the separating line.

The features set forth in the following paragraphs may optionally be implemented, independently of each other or in combination with each other.

The first cutting tool may be configured to make a precut groove from above to a first thickness, the second cutting tool may be configured to make a precut groove from below to a second thickness, and the first thickness may be greater than the second thickness, at least in the vicinity of the convex profile. The precuts are thus made to plastic thicknesses that provide good resistance between pots and a satisfactory separation when breaking them apart.

The device may be formed as a press comprising an upper support plate receiving the first cutting tool and a lower support plate receiving the second cutting tool, the pack of pots of food product being configured to be received between the upper support plate and the lower support plate, the upper support plate and lower support plate having a relative movement that is perpendicular to the plane defined by the upper surface of the pots of food product. The precuts may be formed by moving the upper support plate, moving the lower support plate, or moving the lower support plate and upper support plate.

The device may comprise a plurality of first cutting tools and a plurality of second cutting tools so as to form all the separating lines in a pack of pots of food product. All precuts in a pack may be formed by a single relative movement between the lower and upper support plates. Productivity of the device can then be particularly attractive.

According to another aspect, a system is proposed for preparing packs of pots of food product, comprising:

a first device configured to carry out both a lid sealing operation and, from below, a localized cooling operation of the connecting areas of the pots, and, arranged downstream of said first device, a second device for forming a precut.

According to another aspect, a pack of pots of food product obtained either by a device or by the system is proposed.

BRIEF DESCRIPTION OF DRAWINGS

Other features, details, and advantages will become apparent upon reading the detailed description below, and upon analyzing the attached drawings, in which.

DETAILED DESCRIPTION

Figure 1:
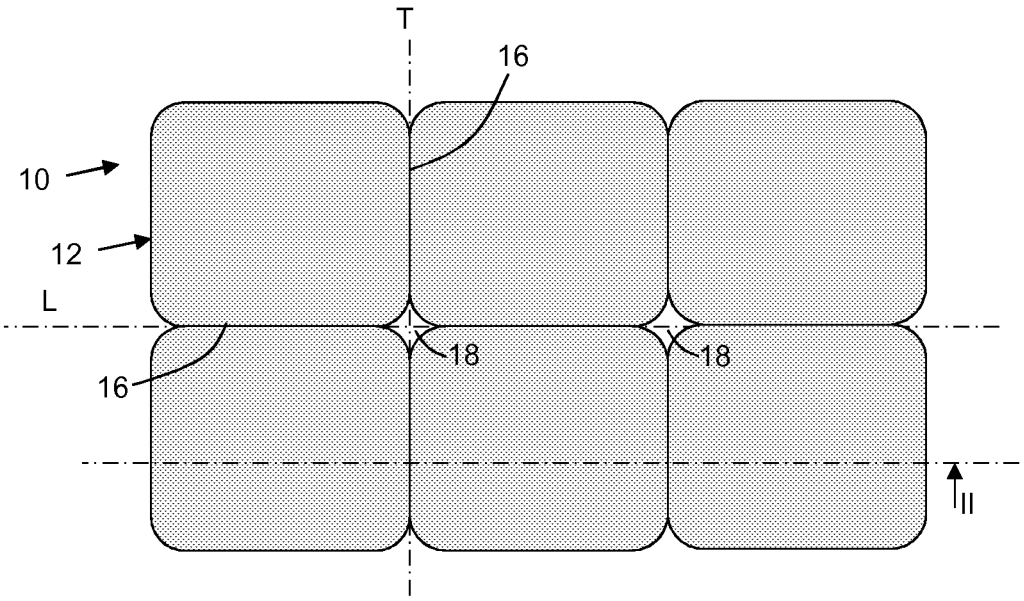
FIG. 1 illustrates a top view of a pack of pots of food product according to one embodiment of the invention.
Figure 2:
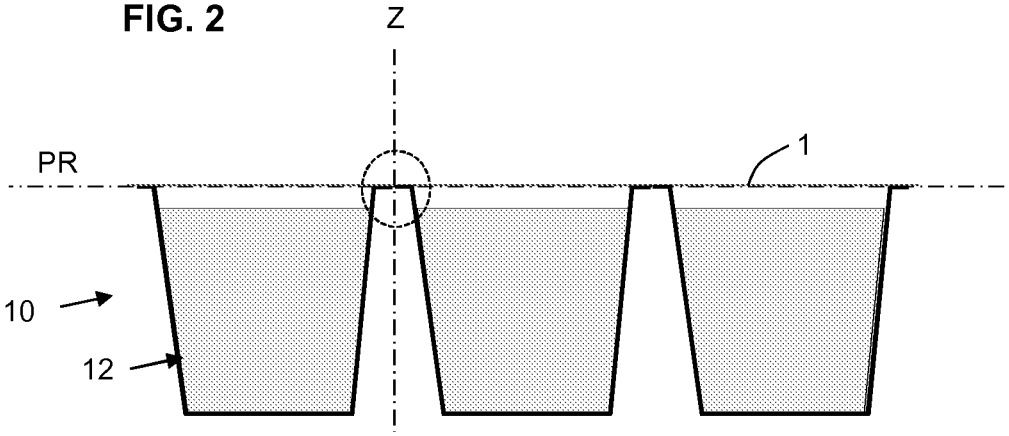
FIG. 2 illustrates a side view of the pack of pots of food product of FIG. 1, according to one embodiment.

FIGS. 1 and 2 represent a pack 10 of pots 12 of food product. The food product may be a conventional food, or a nutraceutical. The food product may be any type of dairy food. The product may be liquid, creamy, pasty, or foamy.

The term 'pack' is understood to be a set forming one sales unit, this set comprising several units for individual consumption (each unit being called a 'pot' or 'cup' here). Each unit for individual consumption forms a food portion for an individual who, after consumption, discards the empty pot, i.e. the primary packaging, into a trash can or a recycling channel.

In the illustrated example, a pack 10 of six pots 12 is shown. However, it should be understood that there can be any number of pots 12, i.e. pack 10 may comprise 2 pots, 4 pots, 6 pots, 8 pots, even 9 pots, 10 pots, indeed even 12 pots.

In the example illustrated, a reference plane PR is defined at the upper surface of pots 12, reference plane PR comprising a longitudinal direction denoted L and a transverse direction denoted T. Further defined is a vertical direction denoted Z, substantially normal to reference plane PR.

Pots 12 of food product, viewed in cross section (perpendicular to reference plane PR), may have a slightly conical shape as illustrated in FIG. 2. Alternatively, there is no conicity and the sides of pots 12 may be strictly parallel to the vertical (i.e. parallel to the Z axis). Pots 12 of food product may also be pots 12 having a convex side wall, which cannot be demolded by a simple mold.

Pots 12 are formed from a multi-compartment container. The multi-compartment container may be formed of plastic. The component material of the multi-compartment container may be polyethylene terephthalate (PET). It should be noted that either translucent PET or opaque PET may be used. Alternatively, the component material of the multi-compartment container may be polypropylene (PP). The plastic material may be blown or injected into a mold in order to obtain the multi-compartment container.

The thickness, denoted e2, of the plastic material of the container may be substantially uniform over the entire multi-compartment container. Thickness e2 is typically between 0.6 mm and 2 mm, at least at the connecting areas between pots 12.

After they are formed, pots 12 are filled with food product and sealed by a cover sheet 14. Cover sheet 14 extends over the upper surface of the pots, i.e. parallel to reference plane PR. Cover sheet 14 has a thickness, denoted e1, that is typically between 0.03 mm and 0.1 mm. The material constituting cover sheet 14 may be formed by a multilayer assembly, with a very thin layer of aluminum foil and a decorative/labeling layer.

It is provided that separating lines 16 are made on all sides where a connection joins a pot 12 to a neighboring pot 12. These separating lines 16 are in reality weakened lines which break apart when one pot 12 is tilted relative to the other. Separating lines 16 allow each pot 12 to be separated for individual consumption. Also provided is the formation of star-shaped holes 18 at the corners between four pots 12. These holes 18 further facilitate the separation of pots 12.

Figure 3:
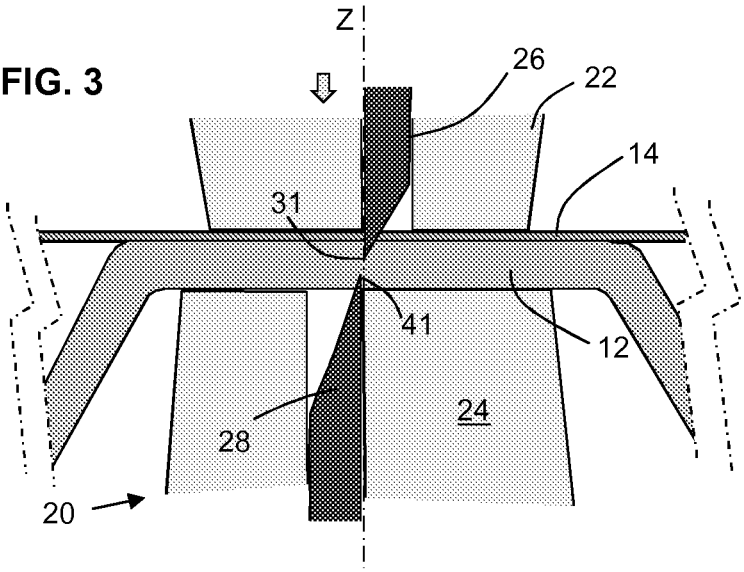
FIG. 3 illustrates a cross-section view of a precutting device making a precut in a separation area between two pots of food product, according to one embodiment.

A precutting device 20 is used to form separating lines 16 and holes 18. Precutting device 20 is shaped like a press. Precutting device 20 essentially comprises an upper support plate 22 and a lower support plate 24. As can be seen in FIG. 3, packs 10 are received between lower and upper support plates 22, 24.

Upper support plate 22 and lower support plate 24 have a relative movement along the Z axis, i.e. the direction normal to reference plane PR. For example, upper support plate 22 may be moved along the Z axis while lower support plate 24 is fixed. Conversely, lower support plate 24 could be moved along the Z axis, or both the lower and upper plates 22, 24 could be movable along the Z axis. Columns or slides may be provided to enable the relative movement along the Z axis and to prevent any other movement, linear or rotational.

Upper support plate 22 receives one or more first cutting tools 26, also called blades or knives. When a pack 10 of pots 12 is arranged between lower and upper support plates 22, 24, first cutting tools 26 extend above separating lines 16. Thus, first cutting tools 26 are adapted to form a precut groove along separating line 16, from above.

Note that upper support plate 22 may also receive one or more star-shaped punches. When a pack 10 of pots 12 is placed between support plates 22, 24, the star-shaped punches are located at holes 18. The punches then allow cutting the star-shaped holes 18.

Lower support plate 24 receives at least one second cutting tool 28, also called blades or knives. When a pack 10 of pots 12 is arranged between lower and upper support plates 22, 24, second cutting tools 28 extend below separating lines 16. Thus, second cutting tools 28 are adapted to form a precut groove along separating line 16, from below.

The number of cutting tools 26, 28 may correspond to the number of separating lines 16 to be created, so that a single movement between upper support plate and lower support plate 22, 24 allows forming all separating lines 16 in a pack 10. It is also possible to provide enough cutting tools 26, 28 to process several packs 10 at the same time. The productivity of device 20 is increased.

Figure 4:
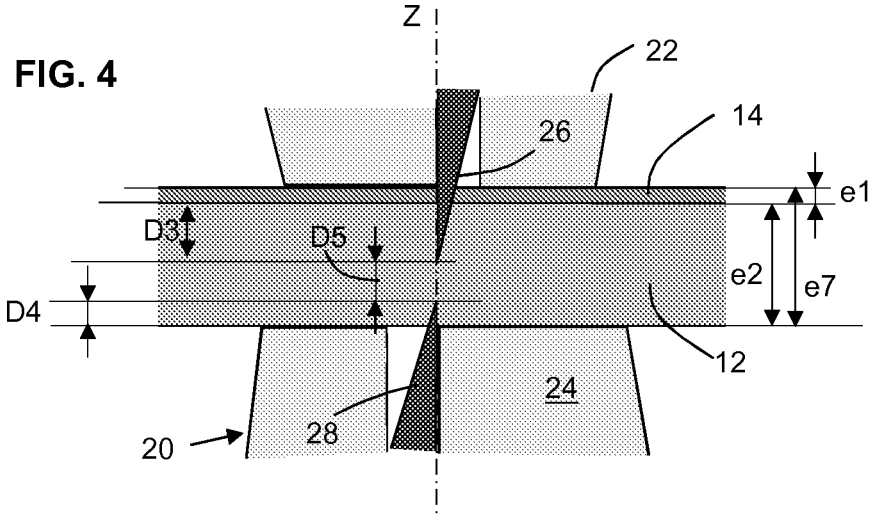
FIG. 4 illustrates details of FIG. 3.

As is more clearly visible in FIG. 4, in particular due to the precision of the press, the depths of penetration of first and second cutting tools 24, 26 into the plastic material of pack 10 is controlled. Control of the penetration depths can be ensured wholly or in part due to the spacing and the relative movement between lower and upper support plates 22, 24. In the current case, the spacing between the two support plates 22, 24 in the working position is fixed at dimension e7, meaning the sum of the thicknesses e1 of cover sheet 14 and the thickness e2 of the plastic material at the connection between pots 12.

Figure 5:
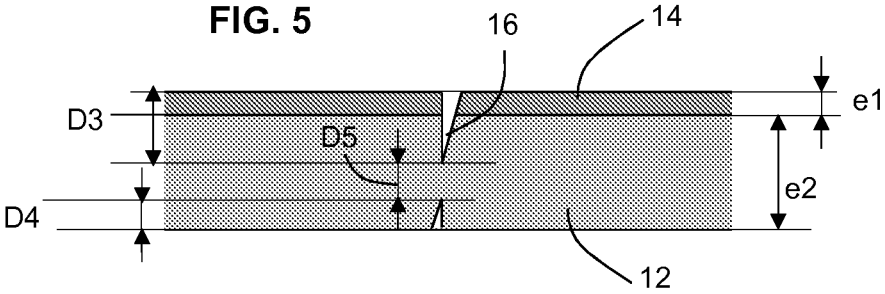
FIG. 5 illustrates a cross-section view of a separation area between two pots of food product according to one embodiment.

As illustrated in FIG. 5, each first cutting tool 26 makes a groove to a height D3 from the top of pack 10, and each second cutting tool 28 makes a groove to a height D4 from the bottom of pack 10. Note that heights D3 and D4 are measured in the direction of the Z axis, substantially in the middle of cutting tool 26, 28 or at the center of separating line 16. Thus, when cutting tool 26, 28 comprises a convex profile as will be described in more detail below, heights D3 and D4 correspond to the maximum height of the grooves made.

Height D3 of the groove made by first cutting tool 26 is between 10% and 80% of thickness e2 of the plastic material, more preferably between 20% and 60% of thickness e2. First cutting tool 26 also makes it possible to cut a groove completely through thickness e1 of cover sheet 14. As for height D4 of the groove made by second cutting tool 28, it is between 25% and 50% of thickness e2 of the plastic material, preferably between 30% and 40%. In the current case, height D3 of the groove made by first cutting tool 26 is greater than height D4 of the groove made by second cutting tool 28. Such grooves ensure good separation of pots 12 along precut lines 16.

A remaining distance D5 is defined which is not cut into by either first cutting tool 26 or by second cutting tool 28. Remaining distance D5 is sufficient for the connecting areas between pots 12 to allow lifting pack 10 of pots 12 by only one or two pots 12 without holding onto the other pots 12. For example, remaining distance D5 is between 20% and 60% of thickness e2 of the plastic material. Preferably, remaining distance D5 is between 25% and 45% of the plastic material.

Figure 6:
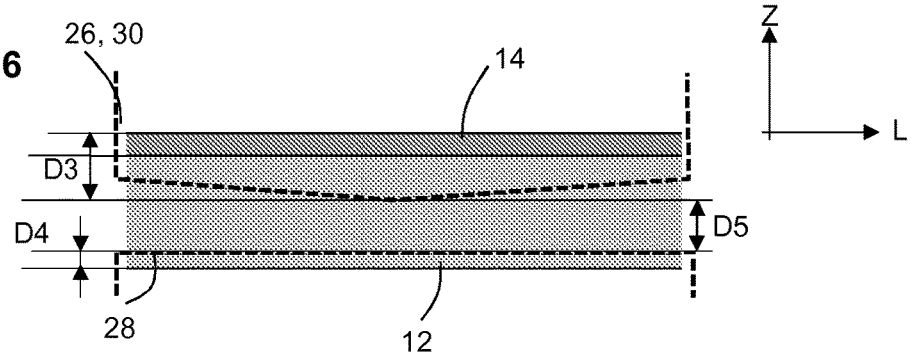
FIG. 6 illustrates a longitudinal section view of a precutting device making a precut at a separation area between two pots of food product, according to one embodiment.
Figure 7:
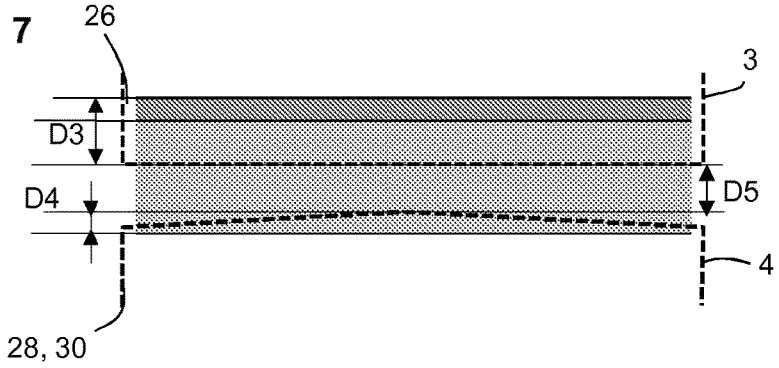
FIG. 7 illustrates a longitudinal section view of another precutting device making a precut at a separation area between two pots of food product, according to one embodiment.
Figure 8:
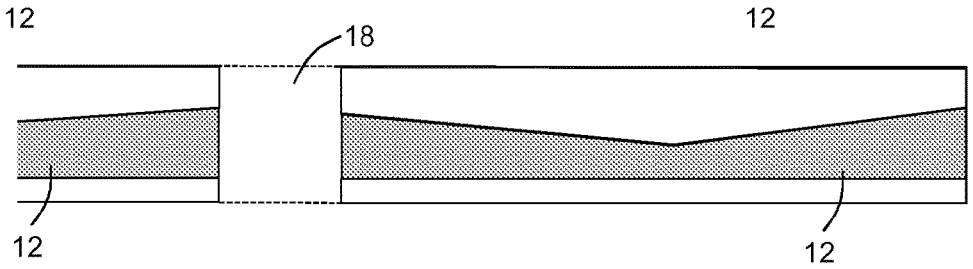
FIG. 8 illustrates a longitudinal section view of a separation area between two pots of food product, according to one embodiment.
Figure 9:
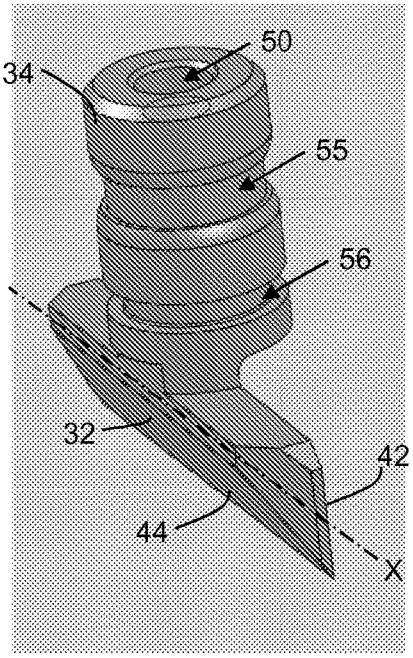
FIG. 9 illustrates a perspective view of a cutting tool that can be used in the device of FIG. 3, 6, or 7, according to one embodiment.

A cutting tool 30 is now described. Cutting tool 30 described below may be a first cutting tool 26, configured to make a precut groove from above in pack 10 of pots 12 of food product, as illustrated in FIG. 6. Cutting tool 30 described below may also be a second cutting tool 28, configured to make a precut groove from above in pack 10 of pots 12 of food product, as illustrated in FIG. 7.

Cutting tool 30 essentially comprises a cutting portion 32, intended to create separating lines 16, and a cylindrical portion 34, suitable for mounting cutting tool 30 in precutting device 20.

Cutting portion 32 extends along a longitudinal axis X. When cutting tool 30 is received in upper support plate and/or lower support plate 22, 24, cutting portion 32 extends along a separating line 16. Cutting portion 32 is adapted to cut into the plastic material so as to form separating lines 16.

Figure 10:
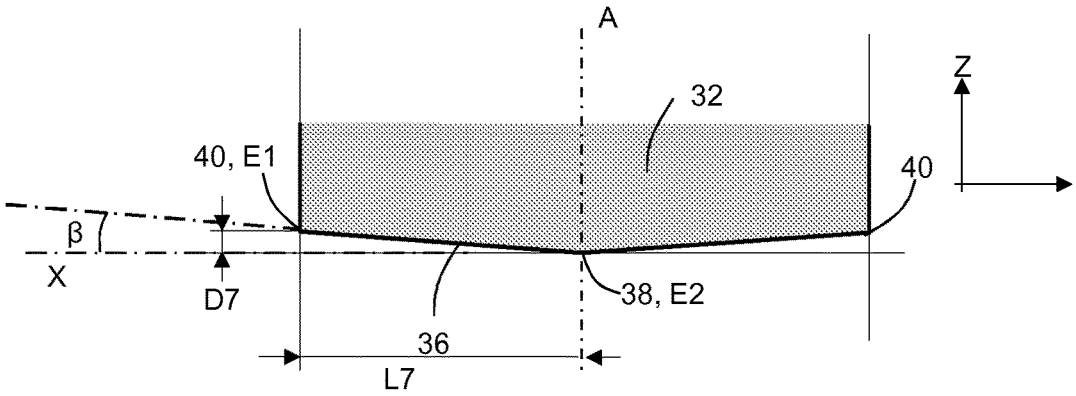
FIG. 10 illustrates a front view of a cutting portion of the cutting tool of FIG. 9, according to one embodiment.

As can be seen in FIG. 10, viewed from the front (perpendicular to the longitudinal axis X), cutting portion 32 comprises a convex profile 36. Convex profile 36 is understood to mean that the profile of the cutting portion 32 comprises a rounded tip 38. Here, convex profile 36 comprises a single tip 38. Convex profile 36 extends to either side of tip 38, towards ends 40 of cutting portion 32, which are set back relative to tip 38. Convex profile 36 makes it possible to vary the depth of the groove made by cutting tool 30 along separating line 16. In the current case, the height of the groove will be maximal in the vicinity of tip 38 of cutting portion 32, and will decrease as one moves away from tip 38. At tip 38, the thickness of the plastic between two pots 12 is minimal. This area is weakened, facilitating the break and reducing the risk of a deviation of the break line relative to separating line 16. The height of the groove decreases as one moves away from tip 38, to ensure a homogeneous break along separating line 16.

Here, convex profile 36 is symmetrical relative to a transverse axis A. Transverse axis A corresponds to a central axis of cutting tool 30. Tip 38 of convex profile 36 is coincident with transverse axis A. Tip 38 of convex profile 36 is located at the center of cutting portion 32. Thus, the minimum thickness of the plastic is located in a central area of separating line 16. The closer one is to the ends of separating line 16, the greater the remaining thickness of the plastic. The progressive increase in thickness towards the ends of separating line 16 ensures good stability between pots 12.

In the current case, convex profile 36 extends to either side of the transverse axis A between a first point E1, on one end 40 of cutting portion 32, and a second point E2, on the transverse axis A of cutting tool 30. The straight line connecting first and second points E1, E2 forms an angle β with the longitudinal axis X that is between 0.1° and 2.2°. In other words, a ratio L7/D7 is defined between the distance L7 between first point E1 and second point E2 measured along the longitudinal axis X and the height D7 between first point E1 and second point E2 measured along the direction normal to the longitudinal axis X. Ratio L7/D7 is between 10 and 100. Angle β is limited in order to maintain rigidity between pots 12 and avoid an undesirable breaking of pots 12, for example when pots 12 are being held by one or two pots 12.

Note that, according to one embodiment, angle β is between 0.3° and 2°, preferably between 0.5° and 1.8°; more preferably between 0.8° and 1.5°. According to yet another embodiment, angle β is between 0.1° and 1.8°, preferably between 0.1° and 1.3°, more preferably between 0.1° and 0.8°. According to yet another embodiment, angle β is between 0.5° and 2.2°, preferably between 1° and 2.2°, more preferably between 1.5° and 2.2°. Angle β can be chosen according to the properties of the plastic to be cut.

Convex profile 36 may have a "V" shape. Tip 38 can then be the point of the V. In other words, when viewed from the front, convex profile 36 can extend substantially along the straight line connecting first and second points E1, E2. Alternatively, convex profile 36 may have a curved shape, tip 38 being a point of inflection of convex profile 36. Then, convex profile 36 extends in a curved manner relative to the straight line connecting first and second points E1, E2.

Figure 11:
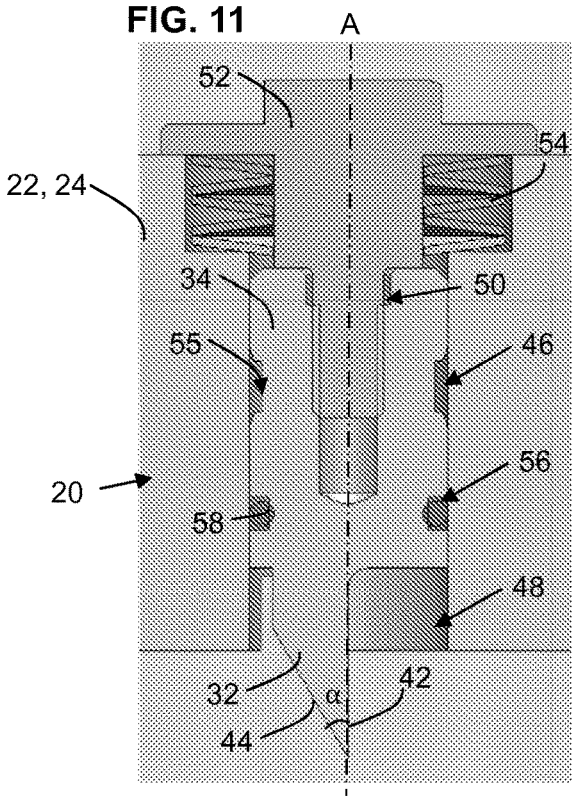
FIG. 11 illustrates a cross-section view of the cutting tool of FIG. 9 mounted in a support plate of a precutting device, according to one embodiment.

Furthermore, as can be seen in FIG. 11, viewed in cross-section (along the direction parallel to the longitudinal axis X), cutting portion 32 has a beveled shape. Cutting portion 32 comprises a first flat face 42 and a second face 44 that is inclined relative to flat face 42. Flat face 42 extends parallel to a plane defined by the longitudinal axis X and the transverse axis 1 (plane AX). Cutting portion 32 is asymmetrical, with flat face 42 forming a sharp-edged profile. Such a cutting portion 32 allows a finer and more precise cut than a symmetrical blade (having a v-shaped profile when viewed in cross-section).

An angle α formed by flat face 42 and inclined face 44 is for example between 10° and 60°. These angles ensure a precise and fine cut into the plastic along separating line 16. Such angles also make it possible to avoid fatiguing cutting portion 32 during repeated cuts, so that the replacement or sharpening frequency of cutting tools 30 is reduced. It appears possible to make precut grooves on plastic of thicknesses between 0.6 mm and 2 mm.

Note that when cutting tools 30 are mounted in device 20, the flat faces 42 of each of cutting tools 30 are face to face. It is then possible to increase the height of the grooves made in the plastic in order to make a complete cut, meaning through the entire thickness e7. Indeed, flat faces 42 make it possible to avoid interference between first cutting tool 26 and second cutting tool 28. For example, a complete cut can allow making a separation between several packs 10 of pots 12 of food product. In this case, a slight offset may be provided between flat faces 42 in order to allow first cutting tool 26 and second cutting tool 28 to meet. Alternatively, in the case of a complete cut, it is possible to make use of one among first or second cutting tool 26, 28 and to provide a counterplate which forms an anvil opposite to first or second cutting tool 26, 28.

Cylindrical portion 34 extends along the transverse axis A, in the direction opposite to cutting portion 32. The axis of revolution of cylindrical portion 34 corresponds to the transverse axis A. Cylindrical portion 34 may be received in a cylindrical housing 46 formed in upper plate and/or lower plate 22, 24 of device 20. Cylindrical portion 34 can be identical regardless of the profile and shape of cutting portion 32, so that different cutting tools 30 can be housed in the same cylindrical housing 46. It should also be noted that, to ensure the correct orientation of cutting tool 30 comprising cylindrical portion 34, upper plate and/or lower plate 22, 24 may further comprise a longitudinal groove 48. Cutting portion 32 projects from longitudinal groove 48 according to the height of the groove to be made.

A threaded hole 50 is formed in cylindrical portion 34. Threaded hole 50 extends along the axis of revolution A of cylindrical portion 34, from an upper face of cylindrical portion 34 towards cutting portion 32. Threaded hole 50 is adapted to receive a retaining screw 52 for device 20. The mounting of cutting tool 30 by means of retaining screw 52 allows precise adjustment of the position of cutting tool 30 in upper plate and/or lower plate 22, 24. Indeed, it is possible to finely adjust the incision height of cutting tool 30, by inserting retaining screw 52 to a greater or lesser extent into threaded hole 50.

According to one example, the adjustment of retaining screw 52 may be made by means of an adjustment screw extending from retaining screw 52 towards an outer surface of device 20. Adjustment screw can be easily accessible by a user who wishes to modify the height of the cut made by cutting tool 30.

Here, a spring 54 is provided between retaining screw 52 and the upper side of cylindrical portion 34. Spring 54 rests on retaining screw 52 and on support plate 22, 24. Spring 54 contributes to the precise adjustment of the height of the cut made by cutting tool 30.

In addition, cylindrical portion 34 here comprises a cylindrical groove 55, its axis the axis of revolution A of cylindrical portion 34. Cylindrical groove 55 ensures good propagation of grease around cylindrical portion 34, in order to grease the relative movement between cutting tool 30 and support plate 22, 24.

In addition, cylindrical portion 34 comprises a cylindrical recess 56, its axis the axis of revolution A of cylindrical portion 34. Cylindrical recess 56 is located between cylindrical groove 55 and cutting portion 32. Cylindrical recess 56 is intended to receive an O-ring 58. A cutting space, comprising cutting portion 32 and packs 10 of pots 12 of food product, is fluidtight relative to the rest of device 20. This thus avoids the introduction of contaminants, in particular grease, into the cutting space.

Cutting tool 30 described above is made of metal, particularly of steel. Cutting portion 32 may comprise a coating, so as to reduce the sharpening frequency of cutting portion 32 during repeated use of cutting tool 30. One will note that when this is associated with convex profile 36 of cutting portion 32, the sharpening frequency can be substantially reduced. The lifespan of cutting tool 30 can be increased.

The invention is not limited to the example embodiments described with reference to the figures, and other embodiments will be clearly apparent to a person skilled in the art.

It is possible to provide that device 20 only comprises first cutting tools 26 or second cutting tools 28. In practice, device 20 comprises at least one cutting tool 30. The at least one cutting tool may be a first or a second cutting tool.

In particular, device 20 described below may be part of a system. The system may comprise a first device configured to carry out a step of sealing lid 14 onto pack 10 of pots 12 and a step of localized cooling in the connecting area between pots 12, and a precutting device 20 as described above.

In the current case, the first device comprises sealing electrodes adapted to come into contact with the upper face of pack 10, and a contact counterplate adapted to come into contact with the connecting area between pots 12 from below. The contact counterplate is preferably thermo-regulated, for example by the circulation of ice water fluid or some other low-temperature fluid in the counterpart. The sealing electrodes and the cooling counterpart sandwich the join area covered by the lid. This thus ensures good pressure by the cooling counterplate and therefore a good conduction heat transfer coefficient in the contact area. Because the cooling is localized, it is selective, and does not significantly affect the food product contained in pots 12.

The invention claimed is:

1. A device for forming a precut in a pack of pots of food product, said precut facilitating the separation of two pots of food product by breaking the two pots of food product apart along a separating line between the two pots of food product, the device comprising at least one cutting tool comprising a cutting portion extending along a longitudinal axis that extends linearly parallel to the separation line and configured to make a precut groove along the separating line, wherein, viewed in a front view taken in a direction perpendicular to the longitudinal axis, the cutting portion comprises a convex profile, wherein the device comprises:

a first cutting tool configured to make a precut groove along the separating line from above, and a second cutting tool configured to make a precut groove along the separating line from below, wherein, viewed from the front view, at least one of the first cutting tool and the second cutting tool comprises the cutting portion having the convex profile, and wherein the first cutting tool is configured to make a precut groove from above to a first thickness, the second cutting tool is configured to make a precut groove from below to a second thickness, and the first thickness is greater than the second thickness, at least in the vicinity of the convex profile.

2. The device according to claim 1, wherein, viewed in the front view, the convex profile is symmetrical relative to a transverse axis of the cutting tool.

3. The device according to claim 2, wherein, viewed in the front view, the convex profile extends between a first point on one end of the cutting tool and a second point on the transverse axis, the straight line connecting the first and second points forming an angle of between 0.1° and 2.2° with the longitudinal axis.

4. The device according to claim 1, wherein, viewed in a cross section-view taken in a direction parallel to the longitudinal axis, the cutting portion comprises a flat face and a face that is inclined relative to the flat face so as to form a beveled cutting portion.

5. The device according to claim 4, wherein an angle formed by the flat face and the inclined face is between 10° and 60°.

6. The device according to claim 1, further comprising a cylindrical portion extending in a direction perpendicular to the longitudinal axis.

7. The device according to claim 6, wherein the cylindrical portion comprises a threaded hole extending along an axis of revolution of the cylindrical portion, the threaded hole being configured to receive a retaining screw for the device for forming a precut, the retaining screw being capable of fixing the cutting tool in a support plate.

8. The device according to claim 7, wherein the cutting tool is configured to be urged by a spring when the cutting tool is making a precut, with the spring pressing against the retaining screw and the support plate.

9. The device according to claim 6, wherein the cylindrical portion comprises a cylindrical recess configured to receive an O-ring of the device for forming a precut.

10. The device according to claim 1, wherein the device is formed as a press comprising an upper support plate receiving the first cutting tool and a lower support plate receiving the second cutting tool, the pack of pots of food product being configured to be received between the upper support plate and the lower support plate, the upper support plate and lower support plate having a relative movement that is perpendicular to the plane defined by the upper surface of the pots of food product.

11. The device according to claim 1, wherein the device comprises a plurality of first cutting tools and a plurality of second cutting tools so as to form all the separating lines in a pack of pots of food product.

12. A system for preparing packs of pots of food product, comprising:

a first device configured to carry out both a lid sealing operation and, from below, a localized cooling operation of the connecting areas of the pots, and, arranged downstream of said first device, a second device for forming a precut, said second device being in accordance with claim 1.

13. A pack of pots of food product, obtained by a device according to claim 1.

* * * * *